United States Patent [19]

Bingham

[11] 4,355,804

[45] Oct. 26, 1982

[54] CLUB AND CLUB HOLDER

[76] Inventor: D. Michael Bingham, 105 West 700 North, Bountiful, Utah 84010

[21] Appl. No.: 282,877

[22] Filed: Jul. 13, 1981

[51] Int. Cl.[3] ..... F41B 15/02

[52] U.S. Cl. ..... 273/84 R; 224/251; 224/914

[58] Field of Search ..... 224/191, 196, 197, 200, 224/251, 252, 914, 242; 273/84

[56] References Cited

U.S. PATENT DOCUMENTS

| | | | |
|---|---|---|---|
| 27,335 | 2/1860 | Rowe | 273/84 |
| 2,859,516 | 11/1958 | McQueary | 224/197 X |
| 3,307,754 | 3/1967 | Anketell | 224/197 |
| 3,944,226 | 3/1976 | Starrett | 273/84 R |
| 4,006,851 | 2/1977 | Kippen | 224/197 |
| 4,203,599 | 5/1980 | Starrett | 273/84 R |

*Primary Examiner*—George J. Marlo

*Attorney, Agent, or Firm*—Thorpe, North & Western

[57] ABSTRACT

A club that may be detachably secured to a carrying ring includes an elongate stick that may be inserted through the carrying ring. A protruding shoulder member on the stick will not pass through the ring, the shoulder member thereby providing a suspension point from which the stick may be suspended by the carrying ring. A locking device is included for detachably securing the stick to the carrying ring, thereby preventing the stick from being pulled or sliding out of the carrying ring unless a release mechanism is manually triggered or maintained.

19 Claims, 7 Drawing Figures

CLUB AND CLUB HOLDER

BACKGROUND OF THE INVENTION

This invention relates to clubs and club holders of the type that are carried by police officers and the like, and more specifically to a club that may be detachably secured to a carrier or holder.

Police clubs, by whatever name they are called (night sticks, police batons, etc.), are well known in the art, U.S. Pat. Nos. 27,335, 3,307,754, and 3,944,226 are known to applicant and disclose various clubs or batons. Such clubs are typically an elongate stick that has a substantially circular cross section. It is also known for such clubs to include a protruding shoulder portion at the base of the handle of the club. The handle of the club is simply one end thereof that may be specially adapted to allow it to be securely gripped by a user of the club. The shoulder portion is typically a radially protruding circumferential member that attaches to the body of the club at the base of the handle. Such a shoulder member may be a rib that is an integral part of the club, a rubber ring, and encircling thong, a split band, or the like. Such radially protruding shoulders serve at least two functions: (1) they provide a convenient stop to keep the hand from slipping from the handle portion to the main body portion of the club; and (2) they provide a convenient means for suspending the club from a suitable carrier.

With respect to the latter function mentioned above, it is known in the art to carry a club in a ring that is secured to the belt, for example, of a user of the club. Such a ring has an inside diameter that is larger than the diameter of the club, thereby allowing the club, or at least the main body of the club, to be inserted therethrough. However, the inside diameter of the ring is selected to be smaller than the outside or maximum diameter of the protruding shoulder member. Thus, the club may be suspended from the carrying ring by merely inserting the club body through the ring and allowing the ring to come in contact with the protruding shoulder member.

Using a carrying ring as a holder for a club having a protruding shoulder member as above-described, while being very simple and allowing the club to be easily and quickly removed, does present some problems and dangers to a user of the club. For example, the club may easily slide out of the ring if the club is jarred or otherwise toppled. Thus, the carrier of the club, such as a policeman, is continually required to stabilize or hold the club in his hand in order to prevent its loss regardless of whether he is stooping, running, climbing, jumping, or engaging in other physical activities or conflict. Furthermore, because of the easy removal of the club from the ring, anyone, including an assailant, may remove the club from the ring while the carrier (such as a policeman) is occupied with securing an arrest, writing, controlling an unruly crowd, or similar activities in which his attention is not directed to maintaining his club in its holder.

Because of the difficulties above mentioned with keeping the club in its holder, a policeman or other user of the club may remove the club from its holder and hold it in his hand when confronted with dangerous circumstances. However, the very existance of the club in the hand of the user may pose a perceived threat which could, in turn, precipitate violence, even though the club was removed from its holder only to secure it.

Thus, there is a clear need in the art for a club that may be detachably secured to its holder, as well as quickly and easily removed from its holder when needed.

SUMMARY OF THE INVENTION

Accordingly, an object of the present invention is to provide a club that may be detachably secured to its holder, thereby preventing loss of the club while the carrier is engaged in other physical activities.

It is a further object of the present invention to provide such a club and holder wherein the club may be quickly and easily removed from the holder by merely engaging a release mechanism as the club is withdrawn, or (in a preferred embodiment) by merely holding in a release mechanism that is already engaged, the whereabouts of this release mechanism not being likely to be known by anyone other than the carrier, thereby preventing an assailant or other unauthorized person from removing the club from its holder.

A further object of the present invention is to provide such a club and holder wherein the release mechanism above described is not readily visible, thereby giving the club and holder the appearance of a conventional club suspended from a conventional carrying ring.

Still a further object of the present invention is to provide such a club that may be readily inserted into its holder without the necessity of setting or priming any release mechanisms or the like, and still having the club automatically secured to the ring once it is inserted thereinto.

An additional object of the present invention is to provide a club and holder as above described that is reliable and safe to use, as well as being relatively easy and inexpensive to manufacture.

The above and other objects of the invention are realized in an illustrative embodiment that includes an elongate stick or club adapted to be carried from a carrying ring. A protruding shoulder member is present on the club or stick at the bottom of the handle portion thereof in conventional fashion so as to allow the stick to be suspended from its carrying ring. However, locking means are included within the stick for detachably securing the stick to the carrying ring, thereby preventing the stick from falling out of or being pulled out of the carrying ring unless a manual release mechanism is held in as the club is withdrawn.

The locking means includes an elongate lever that is pivotally mounted inside of a longitudinal slot or channel near the protruding shoulder member. Resilient force means, such as a spring, are used to protrude one end of this lever out from the surface of the stick below the shoulder member and handgrip portion. This protruding end is ramped upwards toward the shoulder member so that the carrying ring, when slidably moved toward the shoulder member (as would occur when the club is inserted into the ring) contacts the ramp and pushes the protruding end back into the slot, thereby allowing the ring to slide thereover and up to the shoulder member. A hook portion of the protruding end, however, prevents the ring from being slidably moved away from the shoulder member (as would occur, for example, when the club is removed or withdrawn from the carrying ring) unless a trigger release is manually engaged or held in so as to place or keep the protruding hook portion back into the slot or channel.

By merely engaging (pushing in or holding in) the manual trigger release mechanism, the carrier may remove the club from its carrying ring as easily and quickly as a conventional club from a conventional holder. Advantageously, the trigger release mechanism is easily engaged with the hand as the base of the handle portion of the club is encircled and grasped for removal.

BRIEF DESCRIPTION OF THE DRAWINGS

The above and other objects, advantages, and features of the present invention will be more apparent from the following more particular discussion presented in connection with the accompanying drawings, in which.

DETAILED DESCRIPTION OF THE INVENTION

The present invention is best understood by reference to the drawings, wherein like numerals are used to designate like parts throughout.

Figure 1:
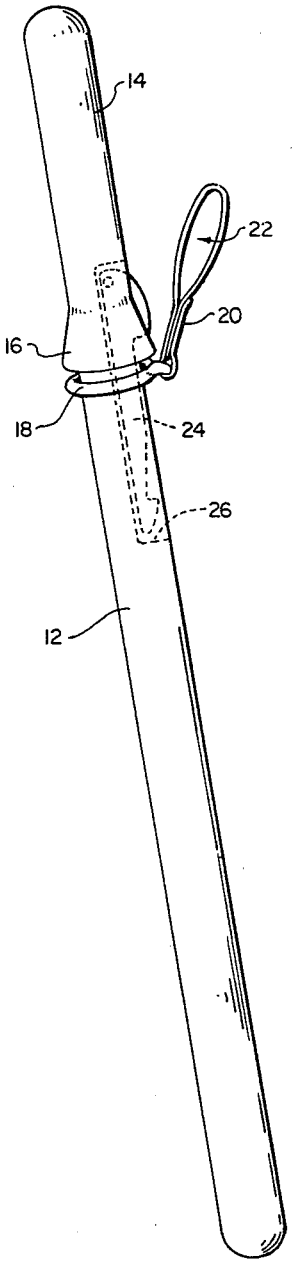
FIG. 1 is a perspective view of the invention as it would appear when suspended from its holder.

In FIG. 1, a perspective view of the club and holder of the present invention is shown. The club comprises an elongate stick 12 having a handle portion 14 and a protruding shoulder member 16. The stick 12 typically has a circular cross section area, with the shoulder member 16 radially protruding out from the stick 12 around the circumference thereof.

A carrying ring 18 is adapted to be slidably inserted over the stick 12 so as to engage the shoulder 16. A flexible strap 20 is secured to the carrying ring 18 and is adapted to be secured to a belt, or other suitable location, of a carrier of the club. In a preferred embodiment, the flexible strap 20 typically includes a loop, shown at 22, through which the belt of the carrier may be inserted.

Figure 2:
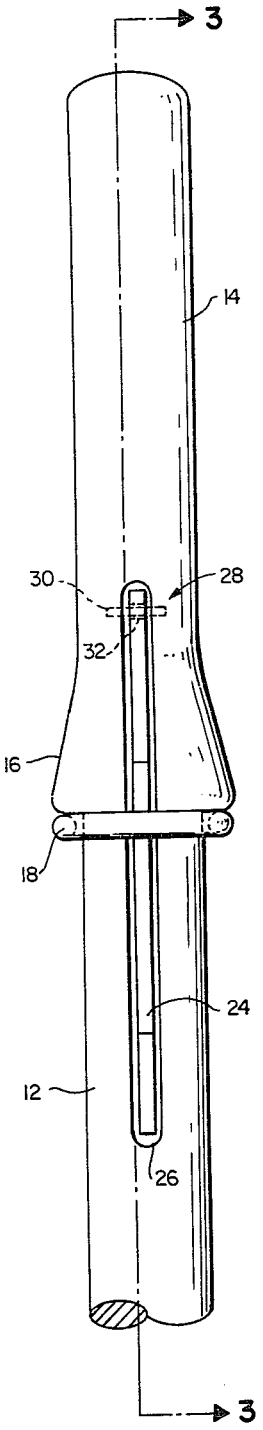
FIG. 2 is a partial side view of the invention showing the slot or channel wherein the trigger release lever is housed.

A lever 24 is pivotally mounted inside of a channel or slot 26. The details of this lever and slot are best shown in FIGS. 2, 3, and 4.

The slot 26 is an elongate slot that is longitudinally positioned within the stick 12 so as to extend above and below the shoulder member 16. The lever 24 is an elongate lever having dimensions only slightly less than the dimensions of the slot 26.

The lever 24 is pivotally mounted at an upper end thereof, as shown at 28, to the inside of the upper end of the slot 26. A pin 30, or similar device, passes through a hole 32 placed in an upper end of the lever 24. It is to be understood that while the drawings show a pin 30 used to pivotally mount the lever 24, numerous methods and devices could be used to perform an equivalent pivoting mounting function. For example, a screw could be inserted into a side of the handle portion 14 of the stick 12 so as to pass through the hole 32.

Figure 3:
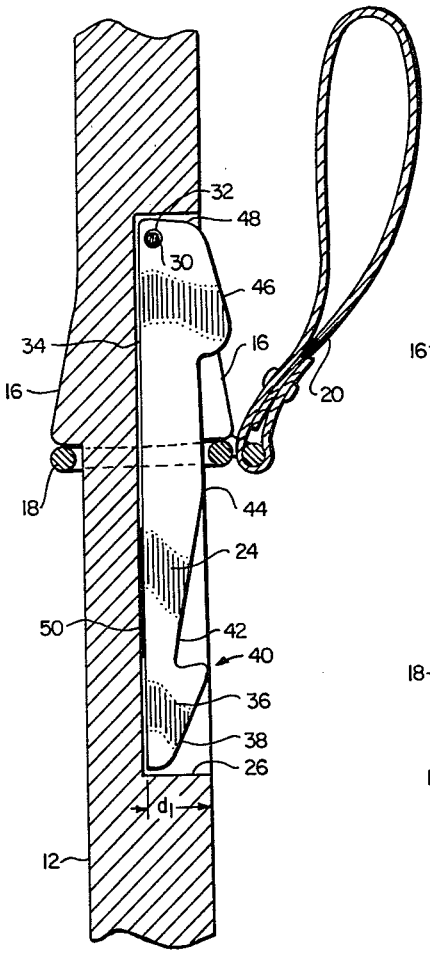
FIG. 3 is a sectional view taken along the line 3—3 of FIG. 2.
Figure 4:
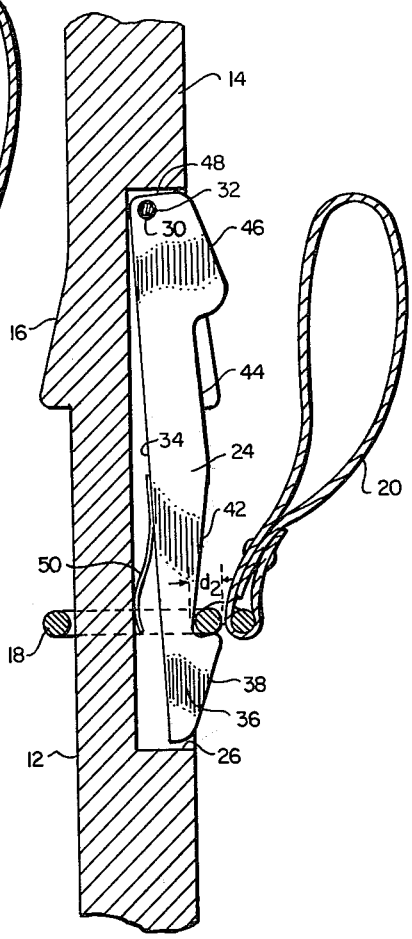
FIG. 4 is a sectional view similar to FIG. 3, but with the release lever extended to prevent removal of the club from its retaining ring.

In the preferred embodiment, the lever 24 is configured as shown in FIGS. 3 and 4. That is, it includes a substantially straight bottom side 34 adapted to come in contact with, or be in close proximity to, the bottom of the channel or slot 26. A hook portion 36 is formed into the lever 24 at the end opposite the pivoting mounting hole 32. This hook portion 36 includes a ramp portion 38 and a valley portion 42. The ramp portion 38 increases the depth of the lever 24 from a minimum depth at the very tip thereof to a maximum depth $d_1$ at 40 (FIG. 3). The valley portion 42 abruptly decreases the depth of the lever 24 a distance $d_2$ (FIG. 4) that is at least equal to the cross sectional diameter of the carrying ring 18. (The inside diameter of the ring 18 must, of course, be sufficiently greater than the outside diameter of the stick 20 so as to allow the ring to readily slide thereover without binding. Thus, in order to ensure the ring will engage the hook portion 36, the distance $d_2$ will typically be slightly greater than the cross-sectional diameter of the ring 18.) The valley portion 42 then ramps up to a flat portion 44 that again brings the depth of the lever 24 to a distance of approximately $d_1$. A trigger portion 46, located towards the upper end of the lever 24, increases the depth of the lever 24 beyond the distance $d_1$ so that it protrudes out of the slot 26 and past the surface of the shoulder member 16.

An upper end 48 of the lever 24 is adapted to come in contact with the upper edge of the slot 26, as shown in FIG. 4, when the lever 24 is pivoted to cause the hook portion 36 to protrude out from the bottom of the slot. Thus, the end 48 acts as a stop mechanism, and two distinct positions of the lever 24 are defined. In a first portion, shown in FIG. 4, the hook portion 36 protrudes out as above described. In a second position, shown in FIG. 3, the lever 24 is pivoted so that the hook portion 36 is completely recessed within the slot 26. Resilient force means are used to push the lever 24 out of the slot 26 into its first position (shown in FIG. 4). In this first position the hook portion 36 protrudes out from the surface of the stick 12 a sufficient distance so as to catch and engage the ring 18.

A leaf spring 50 may advantageously be used to realize the resilient force means. The leaf spring 50 need merely be affixed between the bottom edge 34 of the lever 24 and the bottom of the slot or channel 26. Alternatively, a coil spring 52 (FIG. 7) could be used to realize the resilient force means, as could many other equivalent mechanisms. The springs 50 or 52 thus bias the lever 24 so that, in the absence of any external forces, it will assume the protruding position shown in FIG. 4.

In operation, the lever 24 assumes its first or protruding position whenever the club is used by itself and the trigger portion 46 is not depressed, which depression forces the lever to assume its recessed position (shown in FIG. 3). As the club 12 is inserted into the carrying ring 18, the edge of the ring 18 will contact the ramp portion 38 of the protruding lever 24. However, as manual or gravitational forces cause the club 12 to pass through the ring 18, the ring 18 exerts a force on the ramp portion 38 that causes it to move into the slot 26 and assume its recessed position (shown in FIG. 3). In this fashion, the carrying ring 18 is thereby easily passed over the hook portion 36 of the lever 24. As the ring 18 moves closer to the shoulder member 16, the ring 18 engages the second ramp portion associated with the valley portion 42 and again forces the lever 24 into its recessed position. The lever 24 is maintained in this recessed position so long as the ring 18 encircles the flat portion 44 thereof. Thus, when the club 12 is suspended from the ring 18, as shown in FIGS. 1 and 3, the ring maintains the lever 24 in its recessed, or non-visible, position.

Removal of the club 12 from the ring 18 is typically accomplished by encircling the trigger portion 46 with the hand as the hand grasps the base of the handle portion 14. This manual force maintains the lever 24 in its recessed position and the club 12 may be readily slid out of the carrying ring 18. However, should an unauthorized attempt be made to remove the club 12 from its carrying ring 18 (by an individual not familiar with the operation of the lever 24, which is likely to be the case), then the lever 24 would quickly assume its protruding position, as shown in FIG. 4, and the ring 18 would become caught on the hook portion 36, thereby preventing removal of the club from its holder. The club would be similarly retained within the carrying ring 18 should the club 12 be flipped upside down or otherwise jarred or toppled.

Figure 5:
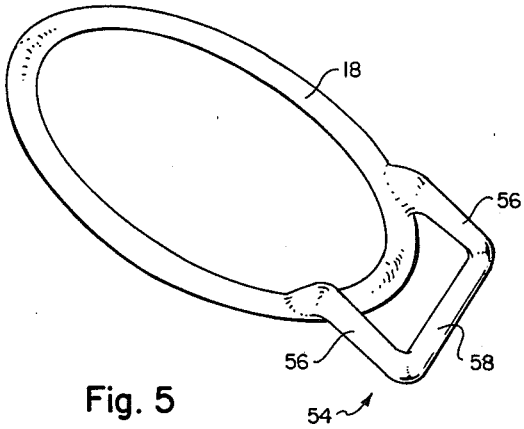
FIG. 5 is a perspective view of a preferred embodiment of the retaining ring used to hold the club.
Figure 6:
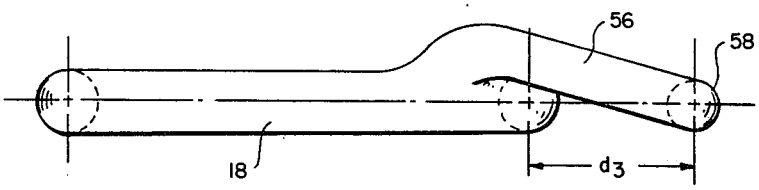
FIG. 6 is a side view of the retaining ring of FIG. 5.

In FIG. 5, there is shown a perspective view of the preferred embodiment of the carrying ring 18. A strap holder 54 is connected to a portion of the ring 18 to provide a suitable loop through which the flexible strap 20 may be secured. The strap holder 54 includes bending protruding arms 56 that attach to respective ends of a straight member 58. The protruding arms 56 attach to the ring 18 towards an upper side thereof and then bend back down so that the resulting straight member 58 is held in the same plane as the ring 18. By maintaining the straight member 58 away from the ring 18, it becomes impossible for the looped strap 20 to inadvertently contact the hook member 36 of the lever 24, and push the lever back into its recessed position. Thus, the distance $d_3$ (FIG. 6) will typically be equal to or greater than the distance $d_2$ (FIG. 4). Further, by placing the straight member 58 in the same plane as the ring 18, the ring will not bind to the stick 12 when the stick is slid out of or into the ring 18.

Figure 7:
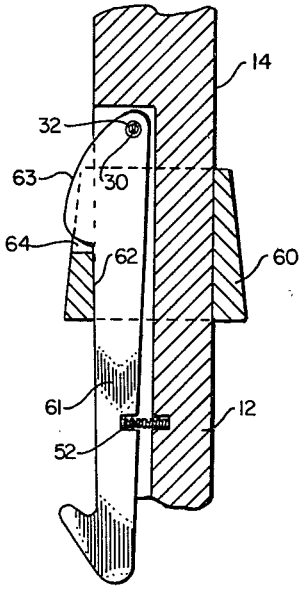
FIG. 7 is a partial sectional view detailing an alternate spring, stop mechanism, and trigger release lever that could be employed with the invention.

In FIG. 7 a partial sectional view detailing an alternative spring, stop mechanism, and trigger level is shown that may be employed with the present invention. In this embodiment, a shoulder ring or collar 60 is slid over the stick 12 so as to be equivalent to the shoulder 16 shown in the other embodiments. This shoulder 60 may be realized from any suitable material, such as rubber. As such, it is simply a collar that is slid into position and suitably secured to the surface of the stick 12. A coil spring 52 is used to force a lever 61 into its protruding position. (A leaf spring could also be used.) It is to be noted that the lever 24 of FIG. 7 does not employ a flat upper end, such as the end 48 in FIGS. 3 and 4, as a stop mechanism. Rather, the lever 61 has an edge 62 along an upper edge thereof that is adapted to come in contact with the inside of the shoulder collar 60. This shoulder collar 60 also has a groove or slot 64 therein that allows the trigger portion 46 of the lever 24 to protrude therethrough. It is also noted that the lever 61 does not employ a ramp portion. As such, it will always assume its protruding position in the absence of a trigger force applied to its trigger portion 63.

Figure 8:
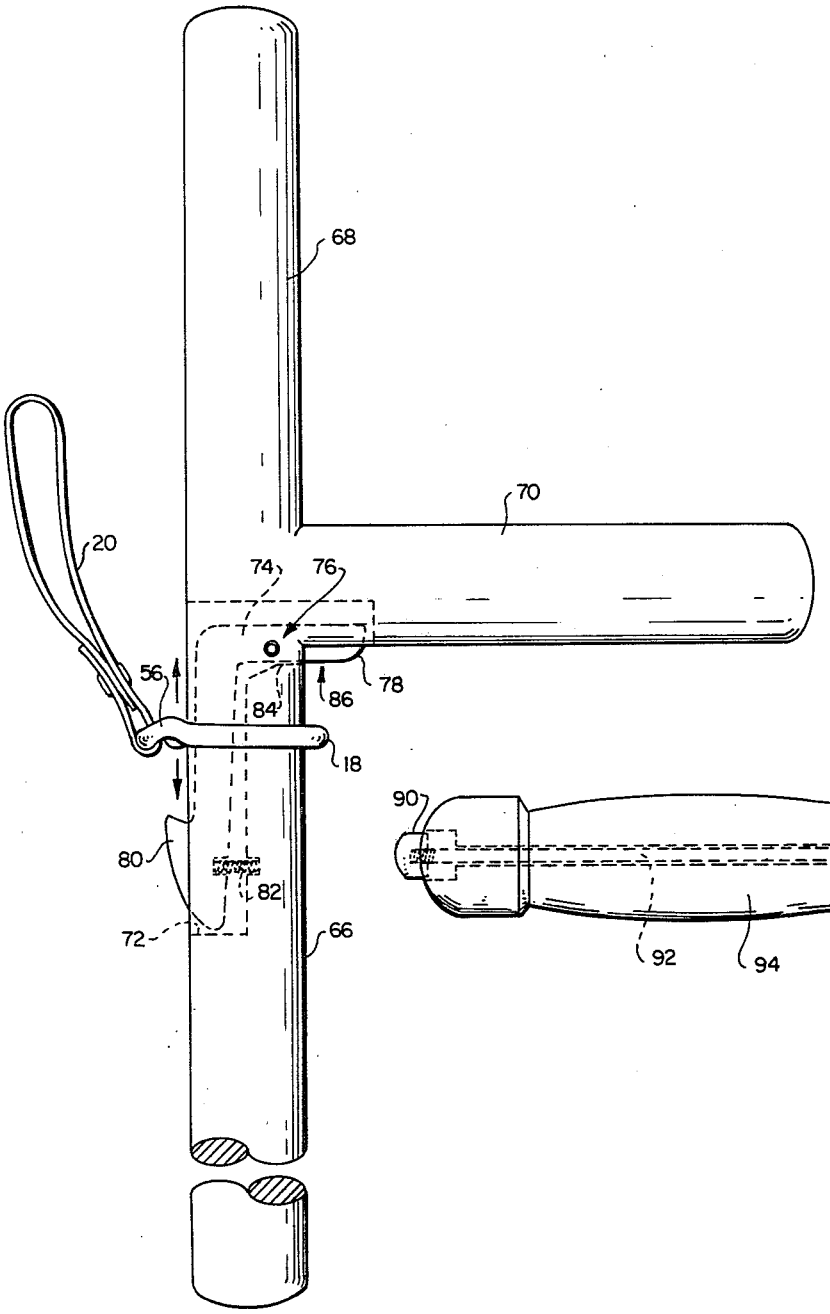
FIG. 8 is a side view of an alternative embodiment of the invention that utilizes an elongate club having two handles, one being roughly perpendicular to the other.

An alternative embodiment of the invention is illustrated in FIG. 8. In this embodiment, a club 66 having transverse handle portions 68 and 70 is employed. (A club arrangement wherein two transverse handle portions are used is commercially available under the tradename Monadmock PR-24. In the embodiment of FIG. 8 (which represents an improvement to a Monadmock PR-24 type of baton), an L-shaped slot or channel 72 is carved out of the club 66 and handle portion 70 as shown. An L-shaped lever 74 is pivotally mounted within this slot or channel 72 at 76. A trigger portion 78 of this lever 74 protrudes out at the bottom of the base portion of the handle 70. A hook portion 80 of the lever 74 protrudes out from the slot or channel 72 as forced by a spring 82. A straight edge 84 of the lever 74 is adapted to come in contact with one of the interior walls of the channel 72 and to serve as a suitable stop means to limit the distance which the hook portion 80 protrudes out from the slot 72.

The carrying ring 18 is adapted to receive the club 66 in the same manner as was described above in connection with the embodiment shown in FIGS. 2, 3, and 4. In the embodiment of FIG. 8, however, the transverse handle portion 70 serves as the shoulder element against which the ring 18 rests when the club is suspended therefrom. Moreover, when the club is thus suspended, the ring 18 contacts the trigger portion 78 at 86, thereby forcing the lever 74 to pivot to its nonvisible position where the hook portion 80 is fully recessed within the slot 72. If desired, an additional channel or slot (not shown) could extend up into the handle portion 68. An extension of the lever 74 could then pass through this channel and a second trigger portion could protrude out at the base of the handle 68.

Figure 9:
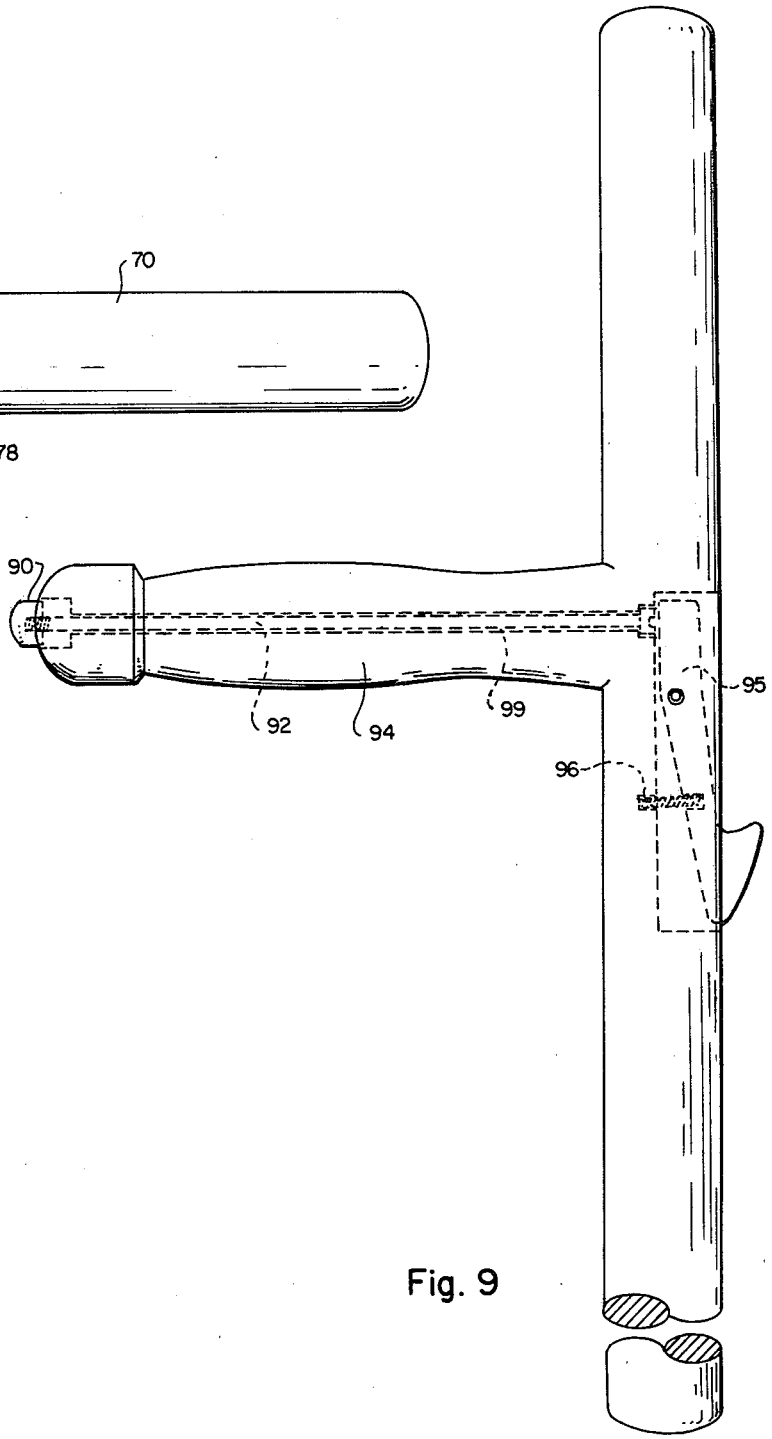
FIG. 9 is a side view of a variation of the embodiment of FIG. 8.

The embodiment of FIG. 9 represents a variation to that shown in FIG. 8. In this embodiment a thumb button 90 is affixed to a first end of shaft 92 that passes through a transverse handle portion 94 so as to come in contact with one end of a trigger release lever 95. A coil spring 96 maintains the lever 95 in its protruding position unless an inward axial force is exerted against the button 90. A head 98, at a second end of the shaft 92 prevents the shaft from sliding out of the handle 94. This head 98 has dimensions larger than the channel 99 through which the shaft 92 passes.

As above described, a club and club holder are disclosed that prevent loss of the club while the carrier is engaging in any physical activity. Furthermore, a secured means is provided that reduces the likelihood of a potential assailant from removing the stick or club from its holder because of his unfamiliarity with the trigger release mechanism. Moreover, because the trigger portion of the lever is always located in very close proximity to the holder (the ring 18, strap 20, and belt or equivalent that passes through the strap 20), the likelihood of a potential assailant unknowingly depressing or holding in the trigger mechanism in an attempt to steal the club from the carrier is greatly reduced. That is, an assailant would likely reach for the "free" or accessible end of the handle portion 14 away from the shoulder portion 16. Further, because the method of detachably securing the stick to the carrier is very reliable, the carrier does not have to preoccupy himself with the necessity of having to hold the club during dangerous circumstances, thereby eliminating the potential of a perceived threat which could precipitate other violence.

As mentioned above, the detachable secured means described herein in no way limits or restricts the carrier from easily and quickly retrieving the club from its holder when it is necessary to do so. All the carrier need do is grasp the base of the handle portion of the club, and at the same time engage or otherwise hold the trigger portion of the securing lever, and retrieve the club from its holder in the usual manner. Further, when it is time to replace the club in its holder, all that need be done is to slidably insert the club therein, as is presently done with conventional clubs. Also, the presence of the lever within the club presents no danger of physical harm to the user of the club or to the person on whom the club is used, other than the inherent danger of the club itself because the hook is rounded and smooth and because it will readily recede into its slot upon contact or impact.

While the invention herein disclosed has been described by means of specific embodiments and applications thereof, numerous modifications and variations could be made thereto by those skilled in the art without departing from the spirit and scope of the present invention. It is therefore to be understood that within the scope of the appended claims, the invention may be practiced otherwise than as specifically described herein.

What is claimed is:

1. A club detachably secured to a carrier comprising:

an elongate stick having a shoulder member at the base of a hand grip portion thereof, said hand grip portion being located towards a first end of said stick;

a carrying ring through which said stick may be slidably inserted, said ring having a size and shape that prevents said shoulder member from passing therethrough, said ring being adapted to be flexibly secured to a desired carrier, such as the belt of a user of the stick, whereby said stick may be suspended from said carrier with said hand grip portion in a generally upright position by slidably inserting a second end of said stick through said ring until said shoulder member engages with said ring; and locking means for selectively preventing said stick from being slidably removed from said ring.

2. A club as defined in claim 1 wherein said locking means comprises:

a lever pivotally mounted to said stick, said lever being adapted to assume a first position wherein a first end of said lever protrudes out from said stick at a point below said shoulder member, said lever being further adapted to assume a second position in response to outside forces wherein said first end is retracted from its protruding position;

resilient force means for biasing said lever in its first position; and trigger means for selectively allowing outside forces to force said lever to assume its second position;

said first end of said lever having a sloping edge adapted to allow passage of said ring thereover whenever said lever has assumed said first position and said ring is slidably moved from the second end of said stick towards said shoulder element, as would occur when said stick is inserted into said carrying ring;

said first end of said lever further having a hooked edge that catches said ring and prevents passage of said ring thereover whenever said lever has assumed said first position and said ring is slidably moved from a position near said shoulder element towards the second end of said stick;

whereby said stick may be readily slid into said carrying ring regardless of the position assumed by said lever, and said stick may be removed from said carrying ring only if outside forces exerted on said trigger means force said lever to assume its second position.

3. A club as defined in claim 2 further including actuating means for causing said lever to assume its second position whenever said stick is suspended from its shoulder element in said carrying ring, whereby the first end of said lever is retracted to a relatively non-visible position, and for causing said lever to assume its first position as soon as said carrying ring slides away from said shoulder element.

4. A club as defined in claim 3 wherein said stick includes an elongate slot or channel placed longitudinally therein, said elongate slot being positioned so as to extend into portions of said stick on both sides of said shoulder element, said lever being pivotally mounted inside of said slot such that when said lever assumes said second position, the first end of said lever is held inside of said slot below the surface of said stick.

5. A club as defined in claim 4 wherein said lever comprises a rigid elongate member having a width and length that are slightly less than the respective width and length of said slot, and wherein the depth of said lever is, but for a trigger portion thereof, no greater than the depth of said slot, whereby said lever may be substantially recessed within said slot when said lever assumes its second position.

6. A club as defined in claim 5 wherein a second end of said lever is pivotally mounted to the inside walls of said slot at an upper end of said slot, said upper end being that end located in the hand grip portion of said stick, and wherein said lever includes a substantially straight bottom edge adapted to be roughly parallel to the bottom edge of said slot when the lever assumes its second position.

7. A club as defined in claim 6 wherein the sloping edge of said first end of said lever comprises a first ramp portion located along an upper edge of said lever that begins at the first end of said lever and increases the depth of said lever from a minimum depth at its first end to a maximum depth at a fixed distance from the first end; and wherein the hooked edge of said first end of said lever includes a valley portion located along said upper edge of said lever that begins at said fixed distance from the first end of said lever, said valley portion abruptly decreasing the depth of said lever by an amount greater than the cross-sectional width of said carrying ring.

8. A club as defined in claim 7 wherein said trigger means comprises said trigger portion of said lever, said trigger portion being located along the upper edge of said lever towards the second end of said lever and including a hill portion that increases the depth of said lever beyond the depth of said slot, whereby said trigger portion always protrudes out from said slot, and further whereby manual forces applied inwardly along the top of said trigger portion pushes said lever into said slot, thereby causing said lever to assume its second position.

9. A club as defined in claim 8 wherein said resilient force means comprises a spring positioned between the bottom edge of said slot and the bottom edge of said lever, said spring being adapted to push the first end of said lever out of said slot.

10. A club as defined in claim 9 further including stop means for preventing said spring from pushing said lever beyond its first position, said first position being further defined as that position where the upper edge of said lever at the narrowest depth of said valley portion is approximately aligned with the top of said slot at the surface of said stick.

11. A club as defined in claim 7 wherein said actuating means comprises:

a second ramp portion located along the upper edge of said lever beginning at the end of said valley portion, said ramp portion increasing the depth of said lever from the narrowest depth of said valley portion to a depth that is approximately the same as said maximum depth associated with said first ramp portion; and a flat portion beginning at the top of said second ramp portion and extending along the lever's upper edge at least up to the point where said shoulder member protrudes out from said stick, said lever having a depth along said flat portion that is approximately the same as the maximum depth associated with said first ramp portion;

whereby said carrying ring, whenever it is slidably moved towards said shoulder element, comes in contact with said second ramp portion and forces said lever towards its second position as said ring slides along said second ramp, said second position being attained as soon as said ring reaches the flat portion of said lever, said second position being maintained for so long as said ring remains around said stick over the flat portion of said lever.

12. A club as defined in claim 2 wherein said stick has a substantially circular cross-section and further wherein said shoulder member radially protrudes out around the circumference of said stick.

13. A club as defined in claim 12 wherein said carrying ring comprises:

a rigid circular ring having an inside diameter that is larger than the outside diameter of said stick;

a strap holder, including a substantially straight member around which a strap may be attached, that is rigidly affixed to, and spaced away from, said rigid ring; and a flexible strap having one end thereof secured to said strap holder, the other end thereof having means for securing said strap to a desired carrier.

14. A club as defined in claim 13 wherein the longitudinal axis of said straight member around which the flexible strap is secured lies in a plane defined by said rigid ring.

15. A club as defined in claim 14 wherein the distance that the straight member is spaced away from said rigid ring is at least as great as the distance the first end of said lever protrudes out from the surface of said stick when said lever has assumed said first position.

16. A club as defined in claim 3 wherein said shoulder member comprises a separate handle that protrudes transversely out from said stick.

17. A club as defined in claim 16 wherein said separate handle has a length that is approximately the same as the length of the hand grip portion of said stick.

18. A club as defined in claim 2 wherein said shoulder member comprises a separate handle that protrudes transversely out from said stick and wherein said trigger means comprises a shaft slidably passing through said transverse handle in a longitudinal direction, a first end of said shaft having a thumb button affixed thereto that protrudes out from the end of said handle, and a second end of said shaft being coupled to said lever, said lever and said shaft being adapted to cause said lever to assume its second position whenever said thumb button is depressed.

19. A method for detachably securing a club to a carrying ring from which the club is suspended, said club being adapted to be inserted into said ring and suspended from a protruding shoulder element thereof, said method comprising the steps of:

(a) placing a narrow longitudinal channel in said club, a lower end of said channel being positioned below the shoulder element of the channel;

(b) pivotally mounting an elongate lever to an upper end of said channel, said lever being adapted to assume one of two positions, a first position of which causes a lower end of said lever to protrude out from the lower end of said channel, a fixed distance, and a second portion of which causes said lever, except a trigger portion thereof, to be recessed within said channel, said trigger portion protruding out from said channel regardless of the position assumed by said lever, said lower end of said lever having a hooked portion that contacts and prevents the carrying ring from slidably passing thereover when said lever assumes said first position and said ring is moving away from said shoulder element, and said lower end of said lever further having a ramped portion that contacts and allows the ring to push said lever towards its second position, thereby allowing the ring to slidably pass thereover, when said ring moves toward said shoulder element;

(c) spring loading said lever so that it is biased towards its first position;

(d) inserting said club through said carrying ring, until the ring comes in contact with the shoulder member of said club, allowing said ring to push the ramped portion of the lower end of said lever into the channel as the ring passes thereover; and (e) holding the trigger portion of the lever whenever it is desired to remove said club from the carrying ring, thereby maintaining the lever in its second position where the hook portion is maintained in the channel below the surface of said club, thereby allowing the club to be slidably removed from said ring.

* * * * *